United States Patent [19]

Byers et al.

[11] Patent Number: 4,757,046

[45] Date of Patent: Jul. 12, 1988

[54] MEROCYANINE DYE-DONOR ELEMENT USED IN THERMAL DYE TRANSFER

[75] Inventors: Gary W. Byers; Derek Chapman, both of Rochester, N.Y.

[73] Assignee: Eastman Kodak Company, Rochester, N.Y.

[21] Appl. No.: 59,442

[22] Filed: Jun. 8, 1987

Related U.S. Application Data

[63] Continuation-in-part of Ser. No. 915,441, Oct. 6, 1986, abandoned.

[51] Int. Cl.[4] ..... B41M 5/035; B41M 5/26

[52] U.S. Cl. ..... 503/227; 8/471; 427/256; 428/195; 428/480; 428/913; 428/914

[58] Field of Search ..... 8/470, 471; 503/227; 427/256; 428/195, 480, 913, 914

[56] References Cited

U.S. PATENT DOCUMENTS

| | | | |
|---|---|---|---|
| 3,933,914 | 1/1976 | Coles et al. | 8/471 |
| 4,632,895 | 12/1986 | Patel et al. | 430/201 |

FOREIGN PATENT DOCUMENTS

| | | | |
|---|---|---|---|
| 217036 | 4/1987 | European Pat. Off. | 503/227 |
| 2521988 | 12/1975 | Fed. Rep. of Germany | 8/471 |
| 210888 | 12/1982 | Japan | 8/471 |
| 214994 | 10/1985 | Japan | 503/227 |

*Primary Examiner*—Bruce H. Hess
*Attorney, Agent, or Firm*—Harold E. Cole

[57] ABSTRACT

A dye-donor element for thermal dye transfer comprises a support having thereon a merocyanine dye dispersed in a polymeric binder, the merocyanine dye being capable of transfer by diffusion to a dye-receiving element upon the application of heat and being incapable of substantial photolysis, the merocyanine dye being substituted or unsubstituted on the bridging methine carbon atoms.

In a preferred embodiment, the merocyanine dye has the formula:

wherein:

A represents —COR, —COOR, —CONHR, —CN, —$SO_2R$ or —$SO_2NR_2$; or A may be combined together with $R^1$ to form a heterocyclic or carbocyclic ring system;

$R^1$ represents —NHR, —$NR_2$, —OR, —SR, or —R;

n represents 0 or 1;

Z represents the atoms necessary to complete a 5- or 6-membered substituted or unsubstituted heterocyclic ring; and each R independently represents a substituted or unsubstituted alkyl group of from 1 to about 6 carbon atoms or a substituted or unsubstituted aryl group of from about 6 to about 10 carbon atoms.

20 Claims, No Drawings

MEROCYANINE DYE-DONOR ELEMENT USED IN THERMAL DYE TRANSFER

This application is a continuation-in-part of application Ser. No. 915,441, filed Oct. 6, 1986, now abandoned.

This invention relates to merocyanine dye-donor elements used in thermal dye transfer which have high maximum dye densities.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

One of the major problems in selecting a dye for thermal dye-transfer printing is to obtain good transfer efficiency to produce high maximum density. Many of the dyes proposed for use are not suitable because they yield inadequate transfer densities at reasonable coating coverages.

It would be desirable to provide dyes which have high transfer densities used in thermal dye-transfer printing.

Japanese Patent Publication No. 60/214994 relates to cyanine or merocyanine dyes which are used in an image recording material. Those dyes, however, are not used in a thermal dye transfer system. Instead, those dyes are light bleachable, such as by flash exposure, to bleach or destroy the dye. Thus, those dyes undergo substantial photolysis or decomposition when exposed to radiant energy. In addition, those dyes absorb at wavelengths substantially beyond the visible spectrum, unlike the dyes of the present invention.

Belgian Pat. No. 647,036 relates to cyan dyes having a benz[c,d]-indole ring which are used to dye acrylic fibers. There is no disclosure in this patent, however, that such dyes would be useful in a thermal transfer element.

A dye donor element in accordance with the invention comprises a support having thereon a dye layer comprising a merocyanine dye dispersed in a polymeric binder, the merocyanine dye being capable of transfer by diffusion to a dye-receiving element upon the application of heat and being incapable of substantial photolysis, the merocyanine dye being substituted or unsubstituted on the bridging methine carbon atoms. By saying that the dyes of the invention are "incapable of substantial photolysis" is meant that the dyes of the invention do not undergo any substantial decomposition when exposed to radiant energy.

By appropriate selection of substituents, the merocyanine dyes employed in the invention may be of cyan, magenta or yellow hue.

In a preferred embodiment of the invention, the merocyanine dye has the formula:

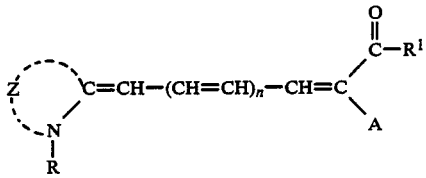

wherein:

A represents —COR, —COOR, —CONHR, —CN, $—SO_2R$ or $—SO_2NR_2$; or A may be combined together with $R^1$ to form a heterocyclic or carbocyclic ring system such as

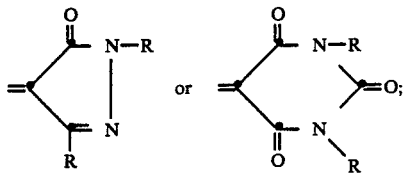

$R^1$ represents —NHR, $—NR_2$, —OR, —SR, or —R;

n represents 0 or 1;

Z represents the atoms necessary to complete a 5- or 6-membered substituted or unsubstituted heterocyclic ring such as 3H-indole, benzoxazole, thiazoline, benzimidazole, oxazole, thiazole; and each R independently represents a substituted or unsubstituted alkyl group of from 1 to about 6 carbon atoms such as methyl, ethyl, propyl, isopropyl, butyl, pentyl, hexyl or such alkyl groups substituted with hydroxy, acyloxy, alkoxy, aryl, cyano, acylamido, halogen, etc.; or a substituted or unsubstituted aryl group of from about 6 to about 10 carbon atoms such as phenyl, p-tolyl, m-chlorophenyl, p-methoxyphenyl, m-bromophenyl, o-tolyl, etc.

In a preferred embodiment of the invention, A and $R^1$ in the above formula are combined together to form the following ring system:

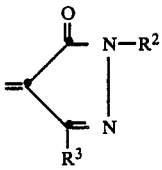

wherein $R^2$ is $CH_3$ or $C_6H_5$; $R^3$ is $CH_3$, H or $COOC_2H_5$; and n is 0.

In another preferred embodiment of the invention, A and $R^1$ in the above formula are combined together to form the following ring system:

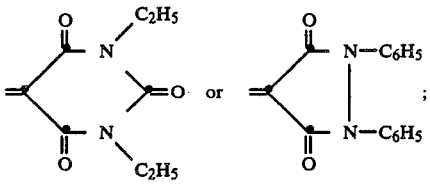
and n is 0.
In yet another preferred embodiment of the invention, A is —CN, n is 0 and $R^1$ is phenyl or an alkyl group of from 1 to about 6 carbon atoms.
Compounds included within the scope of the invention include the following dyes:
Yellow Hue
(1)
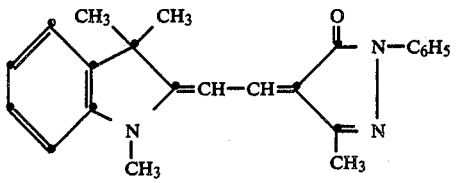
(2)
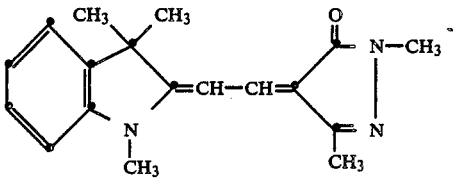
(3)
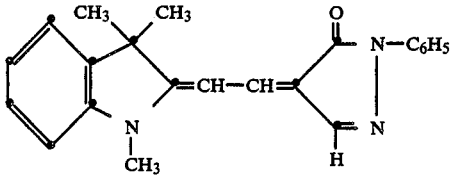
(4)
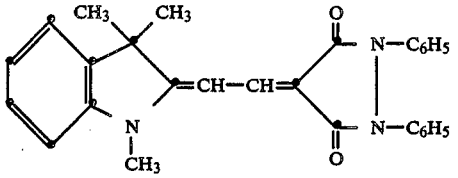
(5)
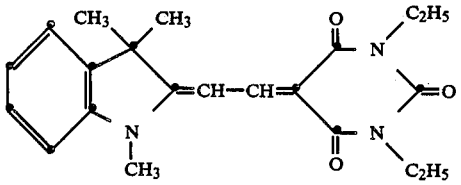
(6)
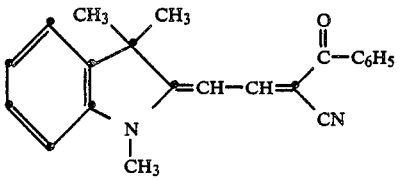
-continued
(7)
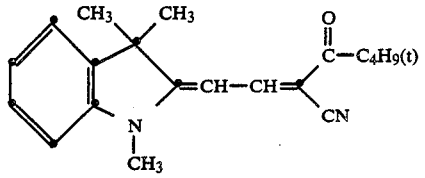
(8)
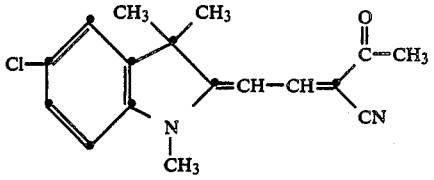
(9)
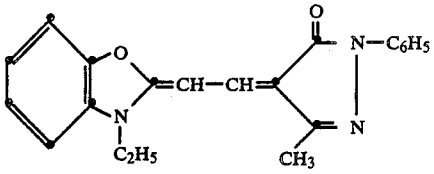
(10)
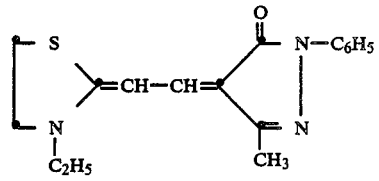
(11)
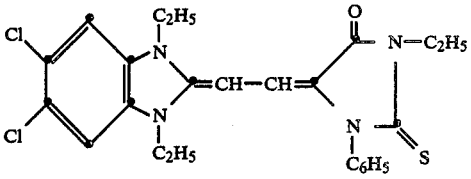
(12)
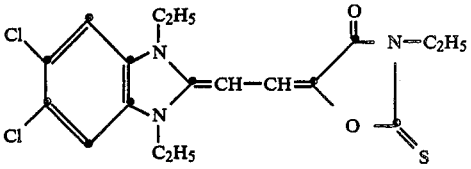
(13)
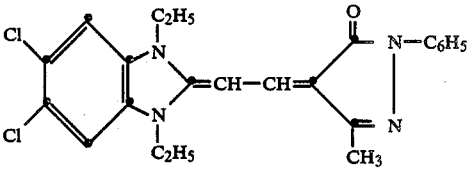
(14)
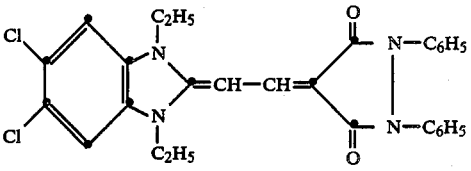
(15)
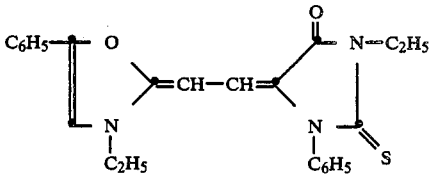

-continued
(16)
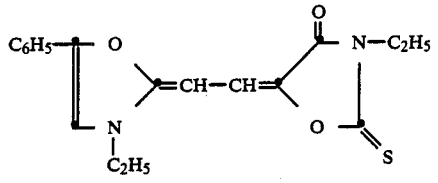
(17)
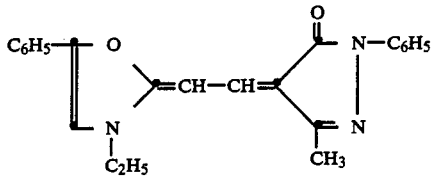
(18)
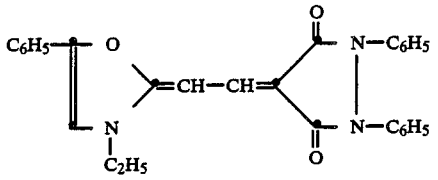
(19)
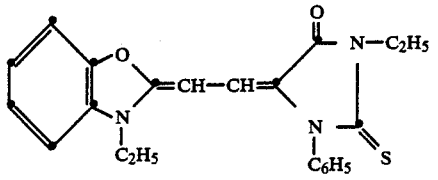
(20)
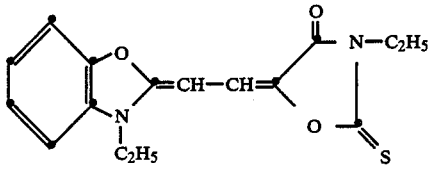
(21)
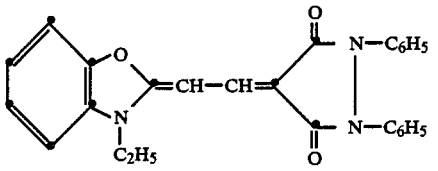
(22)
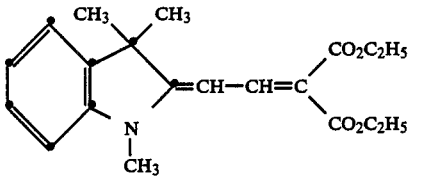
(23)
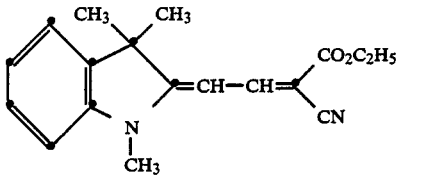
(24)
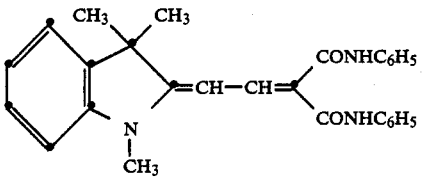
-continued
(25)
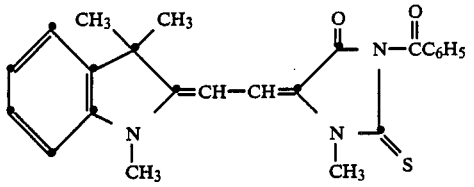
(26)
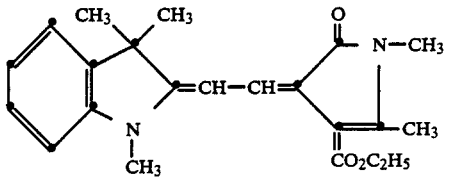
(27)
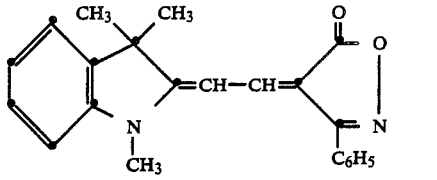
(28)
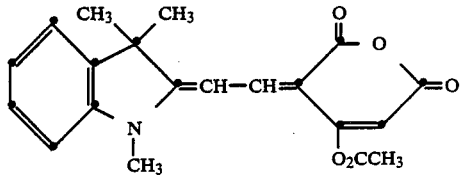
(29)
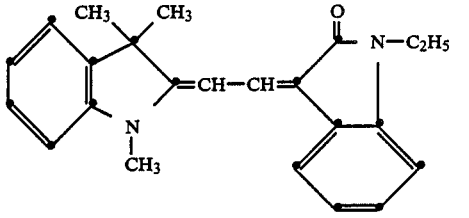
(30)
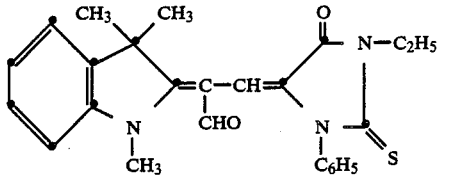
(31)
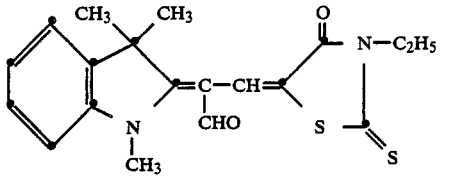
(32)
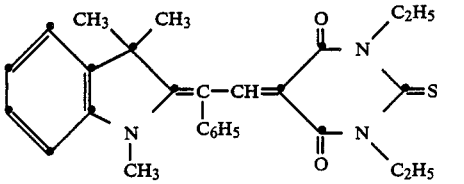

-continued
(33)
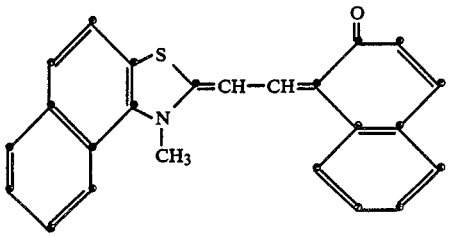
(34)
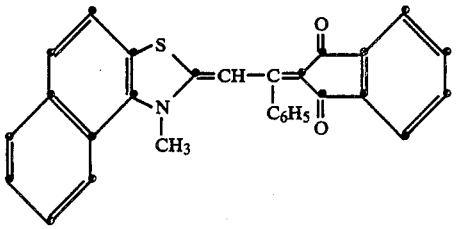
(35)
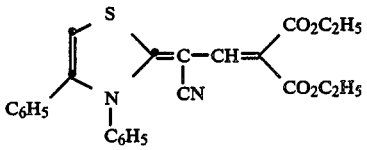
(36)
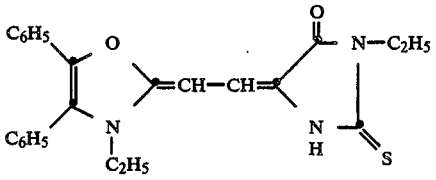
(37)
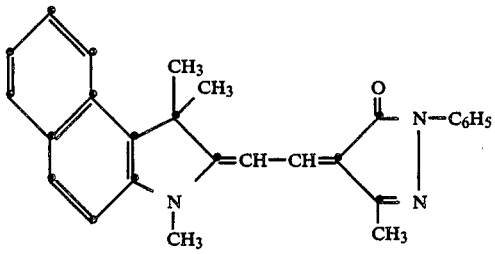
(38)
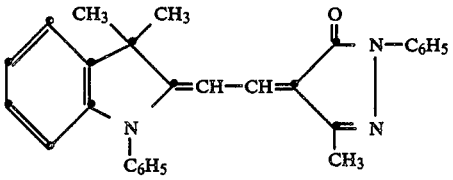
(39)
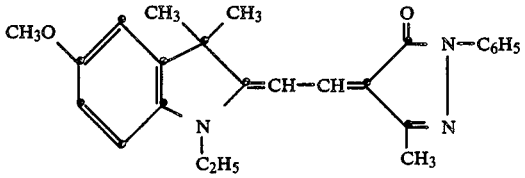
-continued
(40)
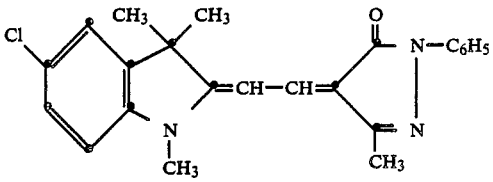
(41)
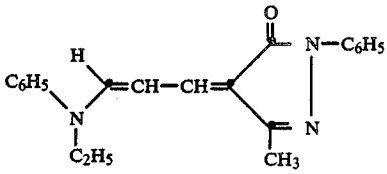
(42)
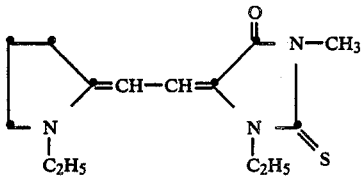
(43)
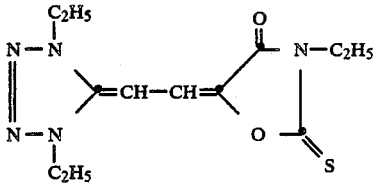
Magenta Hue
(44)
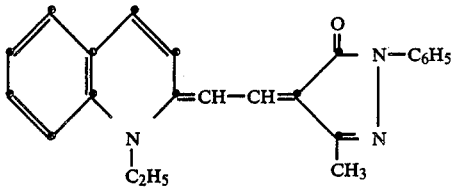
(45)
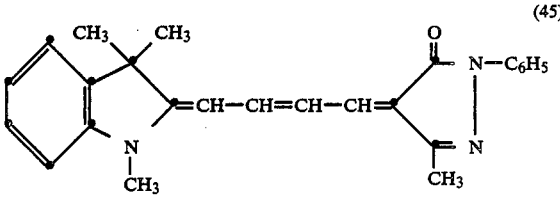
(46)
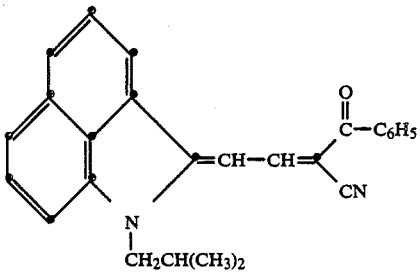

-continued (47)

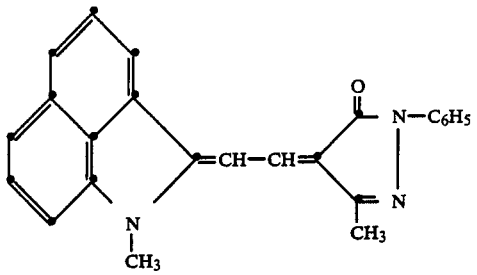

(48)

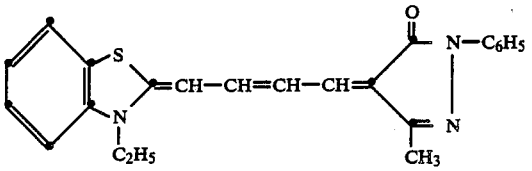

(49)

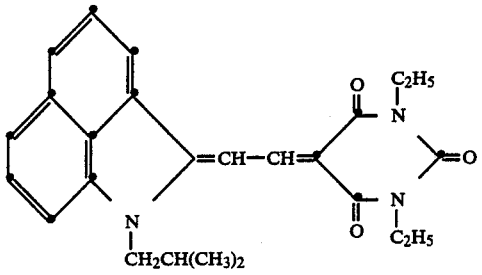

(50)

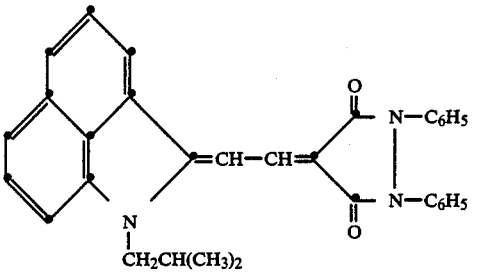

Cyan Hue (51)

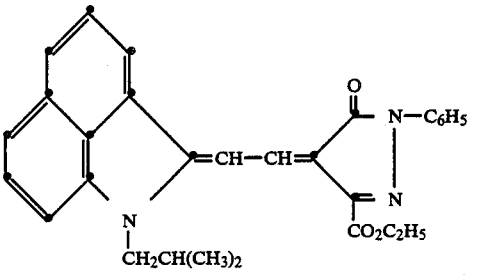

(52)

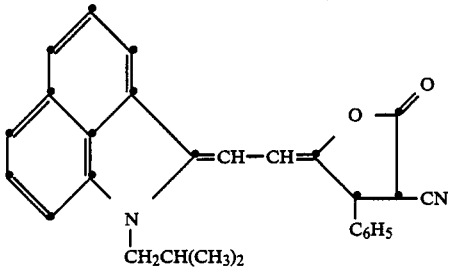

-continued (53)

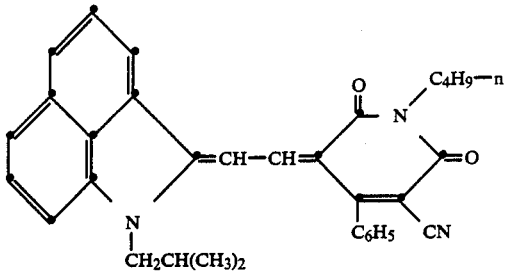

(48) A dye-barrier layer may be employed in the dye-donor elements of the invention to improve the density of the transferred dye. Such dye-barrier layer materials include hydrophilic materials such as those described and claimed in Application Ser. No. 934,968 entitled "Dye-Barrier/Subbing Layer for Dye-Donor Element Used in Thermal Dye Transfer" by Vanier, Lum and Bowman, filed Nov. 25, 1986.

(49) The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

(50) Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

(51) The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal) poly(styrene), poly(vinyl acetate), cellulose acetate butyrate, cellulose acetate, or ethyl cellulose.

(52) The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the yellow dye thereon as described above or may have alternating areas of other different dyes, such as sublimable cyan and/or magenta and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and the yellow dye as described above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Preparation of Compound 1

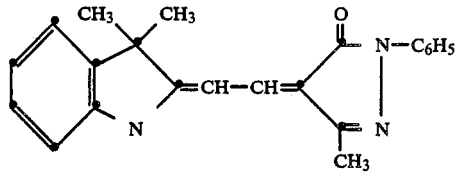

3-methyl-1-phenyl-4-[2-(1,3,3-trimethyl indol-2-ylidene)ethylidene]-2-pyrazolin-5-one To a suspension of 25.0 g (0.056 mole) 1,3,3-trimethyl-2-(2-N-phenylacetamidovinyl)-3-pseudoindolium iodide in 150 mL acetonitrile were added 9.8 g (0.056 mole) 3-methyl-1-phenyl-5-pyrazolin-5-one and 10.0 mL (0.072 mole) triethylamine. The reaction was heated at reflux for 30 min., cooled to 0°–5° C. and the product collected by filtration and washed with cold acetonitrile. After drying in air the yield of material melting at 199°–200° C. was 18.7 g (93.5%). The λ-max in acetone was 476 nm.

EXAMPLE 2

Yellow Dyes

A yellow dye-donor element was prepared by coating the following layers in the order recited on a 6 μm poly(ethylene terephthalate) support:

(1) Dye-barrier layer of poly(acrylic) acid (0.16 g/m$^2$) coated from water, and (2) Dye layer containing a yellow dye as identified in the following Table (0.63 mmoles/m$^2$), a cellulose acetate binder (40% acetyl) at a weight equal to 1.2× that of the dye, and FC-431 ® (3M Corp.) surfactant (2.2 mg/m$^2$), coated from a 2-butanone/cyclohexanone solvent mixture.

On the back side of the element was coated a slipping layer of the type disclosed in copending U.S. patent application Ser. No. 925,949 of Vanier et al. filed Nov. 3, 1986.

A dye-receiving element was prepared by coating a solution of Makrolon 5705 ® (Bayer AG Corporation) polycarbonate resin (2.9 g/m$^2$ in a methylene chloride and trichloroethylene solvent mixture on an ICI Melinex 990 ® white polyester support.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated at increments from 0 to 8.3 msec to generate a graduated density test pattern. The voltage supplied to the print head was approximately 22 v representing approximately 1.5 watts/dot (12 mjoules/dot) for maximum power.

The dye-receiving element was separated from the dye-donor element and the status A blue reflection density at the maximum density was read. The following results were obtained:

TABLE 1

| Compound | Status A Blue D-max |
|---|---|
| 1 | 1.9 |
| 2 | 1.9 |
| 3 | 1.9 |
| 4 | 1.8 |
| 5 | 1.9 |
| 6 | 2.5 |
| 7 | 2.5 |
| 9 | 1.4 |
| 10 | 1.5 |
| 37 | 1.3 |
| 38 | 1.8 |
| 39 | 1.6 |
| 40 | 2.0 |
| 41 | 2.0 |
| 42 | 2.3 |
| 43 | 1.9 |
| Control Cmpd. 1 | 0.9 |
| Control Cmpd. 2 | 1.1 |
| Control Cmpd. 3 | 1.1 |
| Control Cmpd. 4 | 0.3 |

Yellow control compound structures:

Control Compound 1

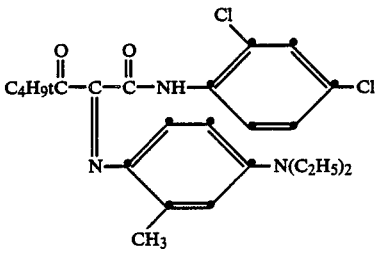

Similar to Dye 1 of EPA 147,747

Control Compound 2

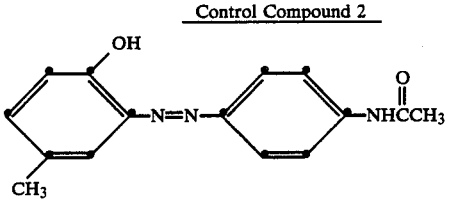

Disperse Yellow 3 ® Aldrich Chemical J60/030,393

Control Compound 3

-continued

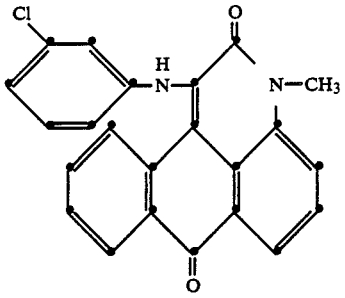

Similar to JP 60/031,560

Control Compound 4

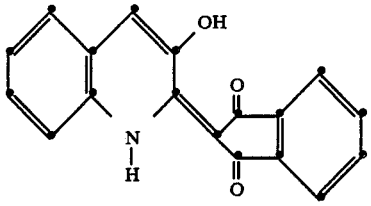

Lurafix Yellow 138 ® BASF Corp. JP 60/053,565

The above results indicate that the merocyanine yellow dyes of the invention produce higher maximum density than a variety of control dyes.

EXAMPLE 3

Magenta Dyes

Example 2 was repeated except that magenta dyes 44–46 and 48–50 were employed and the Green Status A maximum density was measured. The following results were obtained:

TABLE 2

| Compound | Status A Green D-max |
|---|---|
| 44 | 2.5 |
| 45 | 2.8 |
| 46 | 2.7 |
| 48 | 1.9 |
| 49 | 1.8 |
| 50 | 1.6 |
| Control Cmpd. 5 | 0.6 |
| Control Cmpd. 6 | 1.6 |

Magenta control compound structures:

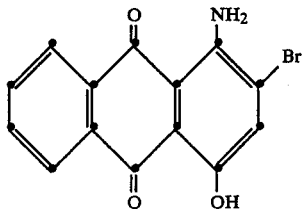

Control Compound 5

Described in JP 60/253,595.

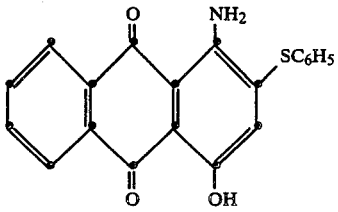

Control Compound 6

Described in JP 60/159,091.

The above results indicate that with one exception, the merocyanine magenta dyes of the invention produce higher maximum density than prior art magenta anthraquinone control dyes.

EXAMPLE 4

Cyan Dyes

Example 2 was repeated except that cyan dyes 51–53 were employed and the Red Status A maximum density was measured. The following results were obtained:

TABLE 3

| Compound | Status A Red D-max |
|---|---|
| 51 | 1.7 |
| 52 | 1.3 |
| 53 | 2.1 |
| Control Cmpd. 7 | 1.2 |
| Control Cmpd. 8 | 0.6 |

Cyan control compound structures:

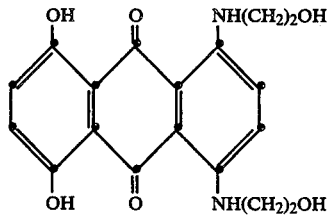

Control Compound 7

Described in JP 60/172,591.

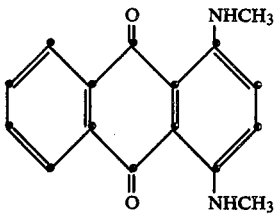

Control Compound 8

Described in JP 60/151,097 and JP 61/035,993.

The above results indicate that the merocyanine cyan dyes of the invention produce higher maximum density than prior art anthraquinone cyan control dyes.

The invention has been described in detail with particular reference to preferred embodiments thereof, but it will be understood that variations and modifications can be effected within the spirit and scope of the invention.

What is claimed is:

1. A substantially nonphotobleachable dye-donor element for thermal dye transfer comprising a support having thereon a dye layer comprising a merocyanine dye dispersed in a polymeric binder, said merocyanine dye being capable of transfer by diffusion to a dye-receiving element upon the application of heat and being incapable of substantial photolysis, said merocyanine dye being substituted or unsubstituted on the bridging methine carbon atoms.

2. The element of claim 1 wherein said merocyanine dye has the formula:

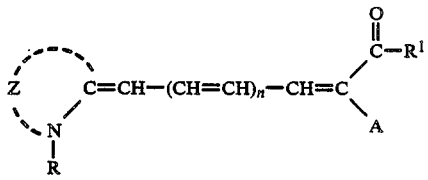

wherein:

A represents —COR, —COOR, —CONHR, —CN, $—SO_2R$ or $—SO_2NR_2$; or A may be combined together with $R^1$ to form a heterocyclic or carbocyclic ring system;

$R^1$ represents —NHR, $—NH_2$, —OR, —SR, or —R;

n represents 0 or 1;

Z represents the atoms necessary to complete a 5- or 6-membered substituted or unsubstituted heterocyclic ring; and each R independently represents a substituted or unsubstituted alkyl group of from 1 to about 6 carbon atoms or a substituted or unsubstituted aryl group of from about 6 to about 10 carbon atoms.

3. The element of claim 2 wherein A and $R^1$ are combined together to form the following ring system:

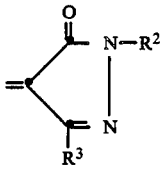

wherein $R^2$ is $CH_3$ or $C_6H_5$; $R^3$ is $CH_3$, H or $COOC_2H_5$; and n is 0.

4. The element of claim 2 wherein A and $R^1$ are combined together to form the following ring system:

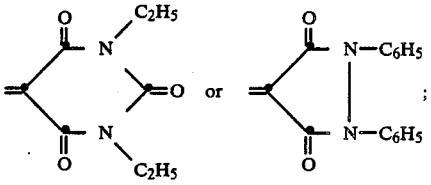

and n is 0.

5. The element of claim 2 wherein A is —CN, n is 0 and $R^1$ is phenyl or an alkyl group of from 1 to about 6 carbon atoms.

6. The element of claim 2 wherein said merocyanine dye is of yellow hue.

7. The element of claim 2 wherein said merocyanine dye is of magenta hue.

8. The element of claim 2 wherein said merocyanine dye is of cyan hue.

9. The element of claim 1 wherein said support comprises poly(ethylene terephthalate), said dye layer comprises sequential repeating areas of cyan, magenta and yellow dye, and at least one of said dyes being said merocyanine dye.

10. In a process of forming a dye transfer image comprising imagewise-heating a substantially nonphotobleachable dye-donor element comprising a support having thereon a dye layer comprising a dye dispersed in a polymeric binder and transferring a dye image to a dye-receiving element to form said dye transfer image, the improvement wherein said dye comprises a merocyanine dye which is capable of transfer by diffusion to a dye-receiving element upon the application of heat and is incapable of substantial photolysis, said merocyanine dye being substituted or unsubstituted on the bridging methine carbon atoms.

11. The process of claim 10 wherein said merocyanine dye has the formula:

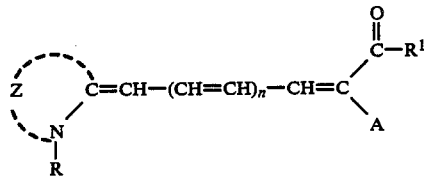

wherein:

A represents —COR, —COOR, —CONHR, —CN, $—SO_2R$ or $—SO_2NR_2$; or A may be combined together with $R^1$ to form a heterocyclic or carbocyclic ring system;

$R^1$ represents —NHR, $—NR_2$, —OR, —SR, or —R;

n represents 0 or 1;

Z represents the atoms necessary to complete a 5- or 6-membered substituted or unsubstituted heterocyclic ring; and each R independently represents a substituted or unsubstituted alkyl group of from 1 to about 6 carbon atoms or a substituted or unsubstituted aryl group of from about 6 to about 10 carbon atoms.

12. The process of claim 10 wherein said support is poly(ethylene terephthalate) which is coated with sequential repeating areas of cyan, magenta and yellow dye, at least one of said dyes being said merocyanine dye, and said process steps are sequentially performed for each color to obtain a three-color dye transfer image.

13. In a thermal dye transfer assemblage comprising:

(a) a substantially nonphotobleachable dye-donor element comprising a support having thereon a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye comprises a merocyanine dye which is capable of transfer by diffusion to a dye-receiving element upon the application of heat and is incapable of substantial photolysis, said merocyanine dye being substituted or unsubstituted on the bridging methine carbon atoms.

14. The assemblage of claim 13 wherein said merocyanine dye has the formula:

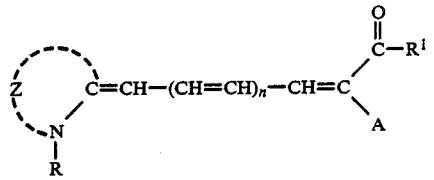

wherein:

A represents —COR, —COOR, —CONHR, —CN, $—SO_2R$ or $—SO_2NR_2$; or A may be combined together with $R^1$ to form a heterocyclic or carbocyclic ring system;

$R^1$ represents —NHR, $—NR_2$, —OR, —SR, or —R;

n represents 0 or 1;

Z represents the atoms necessary to complete a 5- or 6-membered substituted or unsubstituted heterocyclic ring; and each R independently represents a substituted or unsubstituted alkyl group of from 1 to about 6 carbon atoms or a substituted or unsubstituted aryl group of from about 6 to about 10 carbon atoms.

15. The assemblage of claim 14 wherein A and $R^1$ are combined together to form the following ring system:

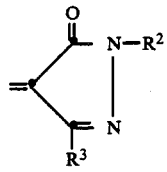

wherein $R^2$ is $CH_3$ or $C_6H_5$; $R^3$ is $CH_3$, H or $COOC_2H_5$; and n is 0.

16. The assemblage of claim 14 wherein A and $R^1$ are combined together to form the following ring system:

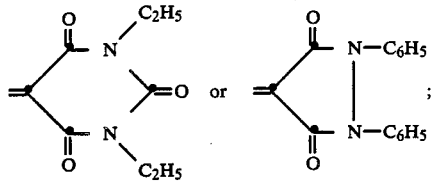

and n is 0.

17. The assemblage of claim 14 wherein A is —CN, n is 0 and $R^1$ is phenyl or an alkyl group of from 1 to about 6 carbon atoms.

18. The assemblage of claim 14 wherein said merocyanine dye is of yellow hue.

19. The assemblage of claim 14 wherein said merocyanine dye is of magenta hue.

20. The assemblage of claim 14 wherein said merocyanine dye is of cyan hue.

* * * * *